United States Patent [19]

Shearer et al.

[11] 3,977,657

[45] Aug. 31, 1976

[54] APPARATUS FOR MIXING PARTICULATE SOLIDS

[75] Inventors: Charles John Shearer, Cambridge; Charles Arthur Martin de Bartolome, Beauchief, both of England

[73] Assignee: Charles John Shearer, Cambridge, England

[22] Filed: June 17, 1974

[21] Appl. No.: 480,315

[30] Foreign Application Priority Data

Oct. 23, 1973 United Kingdom ..... 49345/73

[52] U.S. Cl. ..... 259/180; 259/4 AB

[51] Int. Cl.[2] ..... B01F 5/24

[58] Field of Search ..... 259/4, 180, 150, DIG. 17

[56] References Cited

UNITED STATES PATENTS

| | | | |
|---|---|---|---|
| 829,127 | 8/1906 | Strauss | 259/150 |
| 3,423,076 | 1/1969 | Jacobs | 259/180 |
| 3,424,437 | 1/1969 | Shearer | 259/180 X |
| 3,572,654 | 3/1971 | Jaeger | 259/150 X |
| 3,846,229 | 11/1974 | Kallmes | 259/4 X |

FOREIGN PATENTS OR APPLICATIONS

| | | | |
|---|---|---|---|
| 959,155 | 9/1949 | France | 259/150 |

*Primary Examiner*—Billy J. Wilhite
*Assistant Examiner*—Alan Cantor
*Attorney, Agent, or Firm*—Fleit & Jacobson

[57] ABSTRACT

A mixer for particulate solid material including a hollow casing of polygonal e.g. square or triangular cross-section, the casing having two or more materials fed to it and having disposed therein at least one set of partitions which divide the casing up into a plurality of channels also of polygonal cross-section, the shape of the channels generally being the same as the shape of the casing, some, but not all, of the channels, having a redistributor therein which will allow the material flowing therethrough to be redistributed across the cross-section of that channel. The redistributor disclosed is a generally helical element which is shaped so as to fill the polygonal section of the channel into which it is fitted.

10 Claims, 7 Drawing Figures

APPARATUS FOR MIXING PARTICULATE SOLIDS

The present invention relates to apparatus for mixing particulate solid materials.

Various forms of mixers for mixing particulate solid materials are known. A basic form of mixer comprises a container in which is disposed a beater or paddle which effects a simple stirring action on the material within the container. Another known form of apparatus is that for example described in U.S. Pat. No. 3,286,992 in which the material to be mixed is passed through a hollow tube in which are mounted, in seriatim, a number of helical or part helical elements. The leading edge of one helical element abuts the trailing edge of the preceding helical element and the mixing is carried out by the helical element, in effect, cutting the material in two and then into four etc, the whole of the material passing through the tube being turned over on itself. Such an apparatus is satisfactory for mixing liquid, but it is not so suitable for mixing solid materials.

It is now proposed, according to the present invention to provide an apparatus for mixing particulate solid materials, such apparatus comprising a hollow casing of polygonal cross-section, the polygonal shape being such as to allow the polygon to be divided up into a plurality of similar smaller polygons of identical shape, at least one set of partitions within the said casing dividing the casing into a plurality of channels also of polygonal cross-section arranged side by side in the casing; the shape of the channels being substantially the same as that of the casing and redistributors located in some, but not all, of the channels of a set, to allow the flow of solid particulate material to be redistributed across the cross-section within each channel in which a redistributor is located.

The polygonal shape of the casing, and of the channels, must be such as to allow the polygon to be divided up into similar smaller polygons of identical shape. Two polygonal shapes which do allow this are triangles and squares.

By the term "redistributor" is meant a device within the channel which will allow material flowing therethrough to be redistributed across the cross-section of that channel. A particularly suitable form of redistributor is a generally helical element which is shaped so as to fill the polygonal section of the channel into which it is fitted.

With the apparatus of the present invention, since not all of the channels have redistributors therein, only a fraction, preferably approximately half, of the total quantity of particulate material is in fact displaced. Such an arrangement is far more efficient than other forms of mixer of this general type. The normal mixer in fact moves all of the material laterally at each stage, whereas in the construction of the present invention part of the material is left in its previous lateral position and the other material is moved to be mixed with it.

Preferably the apparatus of the present invention has more than one stage, and at each stage there will be more channels than in the preceding stage, only some of the subsequent channels having a redistributor therein.

With the construction described above, two quantities of different particulate materials can be mixed equally and intimately with one another.

Preferably, therefore, at least one valving element is movable transversely of the channel to block off a portion of the cross section thereof. The valving member or members may comprise of a plurality of parallel spaced apart slats, and the spacing and width of the slats may, if desired, be equal to one another.

In another construction, the channels are of square cross-section and at least one valving element is provided comprising a series of square plates of the same size as the channels over which they move, and a grid of parallel rods which are disposed diagonally of the channels, the plates being mounted so that they are arranged in chequerboard fashion with square spaces formed therebetween. With this arrangement, the valving member may be moved parallel to one of the sides of the square plates to open and close off respectively one or other of the channels of the stage thereabove.

In order that the present invention may more readily be understood, the following description is given, merely by way of example, reference being made to the accompanying drawings, in which.

Figure 1:
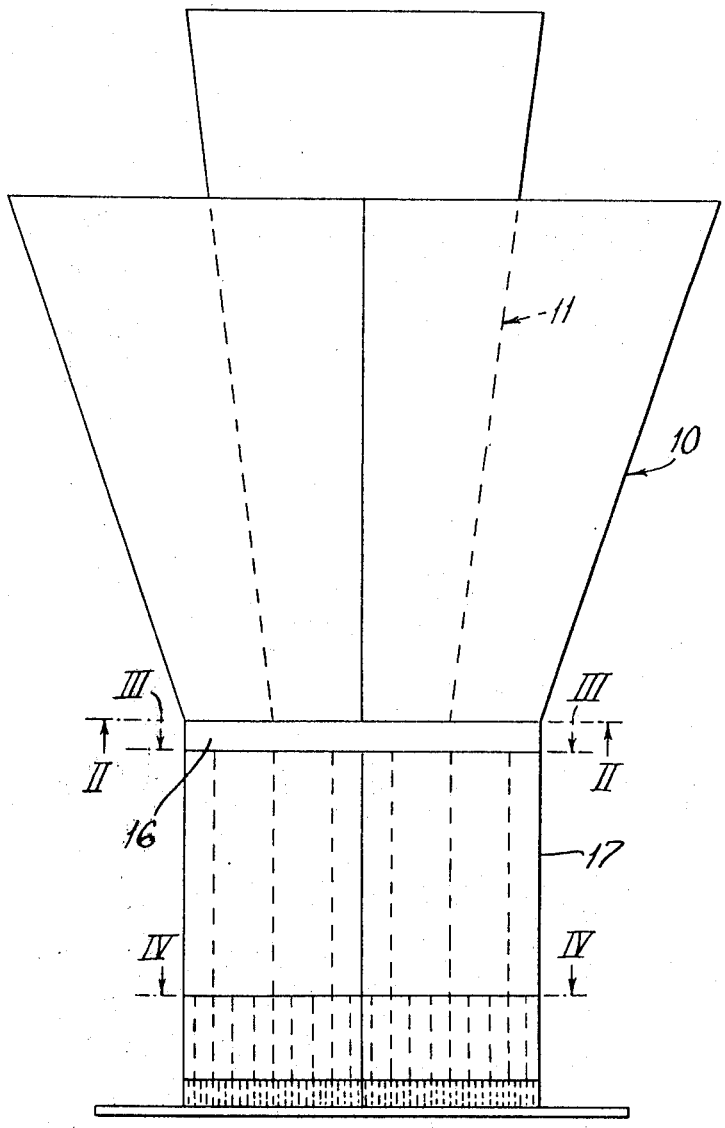
FIG. 1 is a schematic side elevation of one embodiment of apparatus according to the invention.
Figure 2:
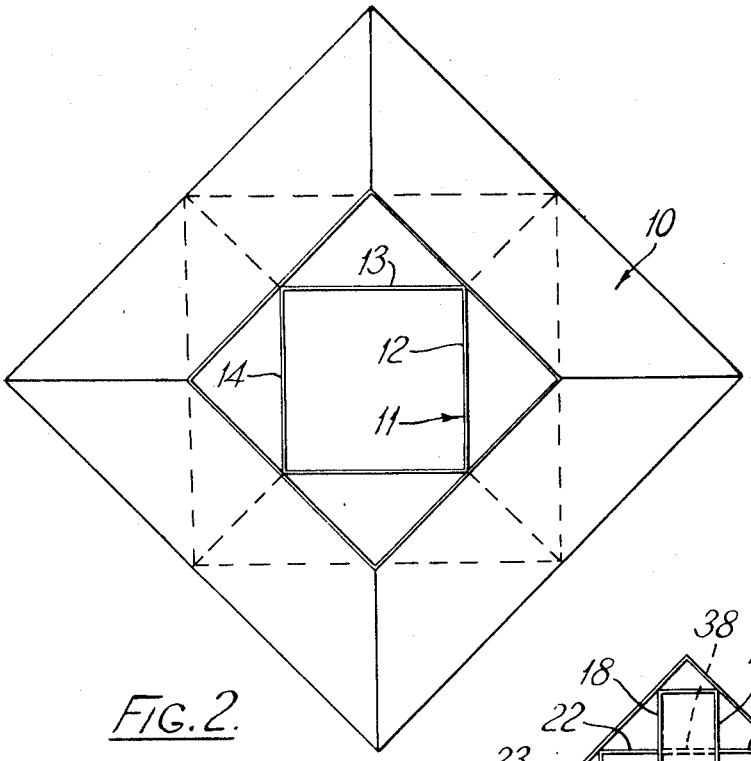
FIG. 2 is a section taken along the line II—II of FIG. 1.

Referring first to FIG. 1, the apparatus illustrated includes a hopper 10 of square cross-section and mounted within this a seed duct also of square cross-section defined by four partitions 12, 13, 14 and 15 disposed at 45° to the wall of the hopper section, as can be seen in particular in FIG. 2. A slide valve 16 illustrated schematically in FIG. 1, is located immediately below the hopper 10 and is effective to cut off the downward flow of the particulate material from the hopper 10 and the duct 11.

Figure 3:
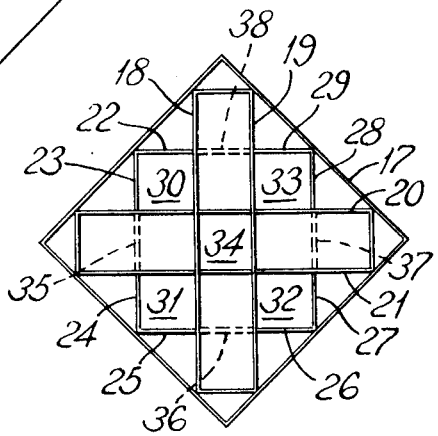
FIG. 3 is a section taken along the line III—III of FIG. 1.
Figure 5:
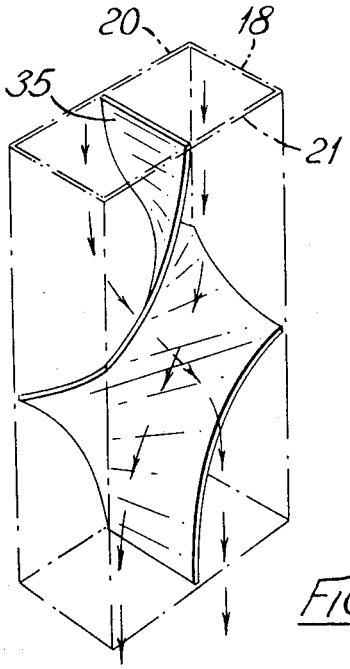
FIG. 5 is a schematic perspective view of one form of redistributor for use in the apparatus of FIGS. 1 to 4.

Extending below the slide valve 16 is a square cross-section casing 17 which, as can be seen from FIG. 3, has a first redistribution stage which is subdivided up by partitions extending at 45° to the wall of the casing 17. These partitions include two pairs of parallel walls 18, 19 and 20, 21 extending on either side of the diagonal of the square casing 17 and eight smaller partitions 22 to 29. The effect of this is to provide five square cross-section channels 30 to 34 and four rectangular cross-section channels each having double the area of the square channels, the rectangular channels having located therein helical elements indicated schematically by dotted lines 35 to 38. These helical elements are chosen so as to redistribute particulate material from one half of the rectangle to the other half of the rectangle. One particular form of such redistributor is illustrated in FIG. 5 and by way of example this has been taken to be the distributor 35. As can be seen from this Figure the redistributor is in the form of a helical element which entirely fills the rectangular cross-section channel in which it is fitted.

Figure 4:
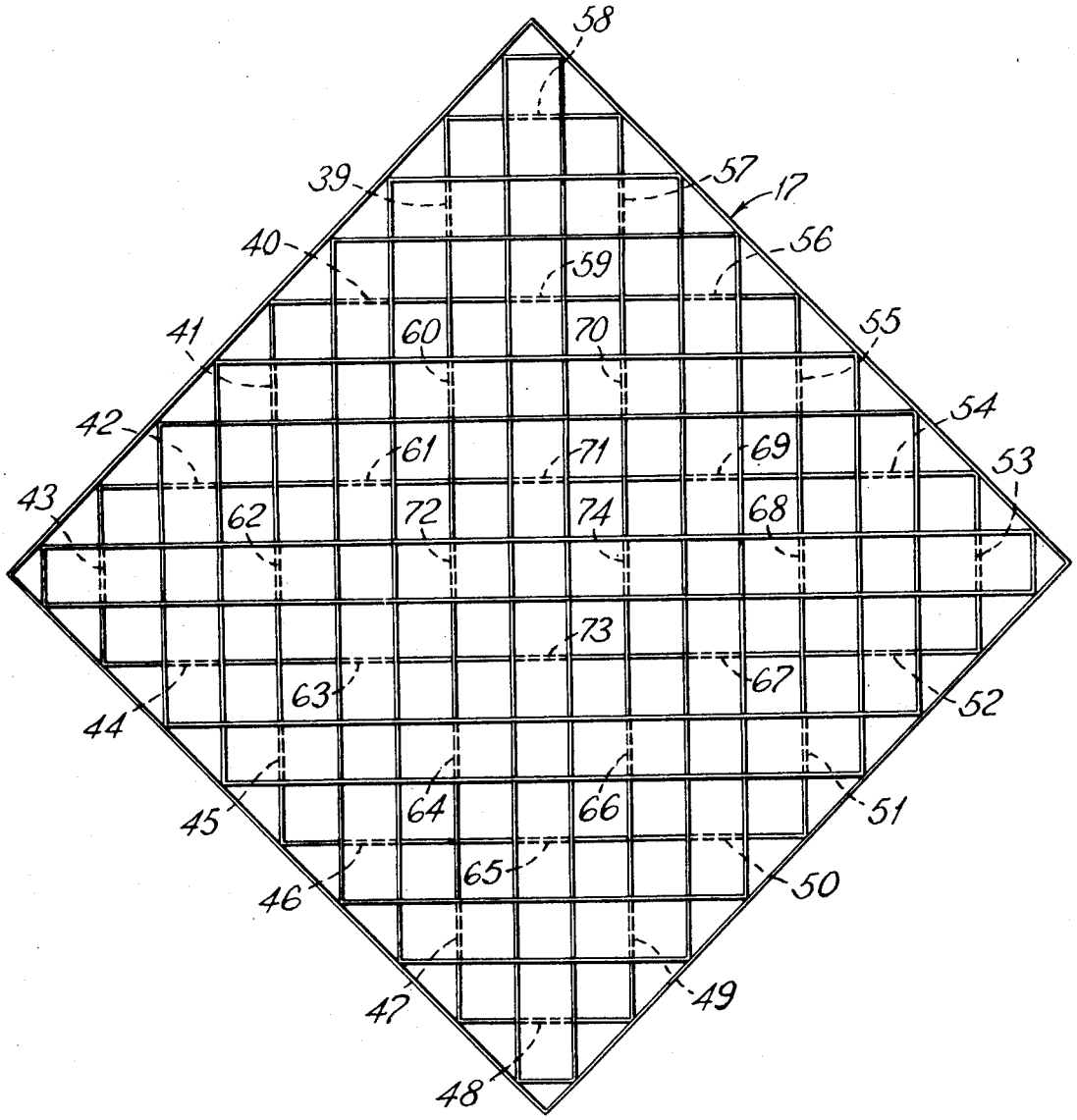
FIG. 4 is a section taken along the line IV—IV of FIG. 1.

As can be seen from FIGS. 1 and 4, the casing 17 is provided therebelow with a second redistribution stage partitioned off in a similar way to that illustrated in FIG. 2 except that, of course, there are a much larger number of partitions. The arrangement is exactly as before with square cross-section channels which have nothing therein and rectangular cross-section channels which have helical redistribution elements therein. For the sake of simplicity, only the 36 redistribution elements 39 to 74 have been referenced.

As shown in FIG. 1, located below the redistribution section 2 is a further redistribution section 3. Here again there is a further subdivision into square and rectangular cross-section channels, the rectangular cross-section channels having a helical redistribution element therein. Further description to these is not deemed necessary.

Figure 6:
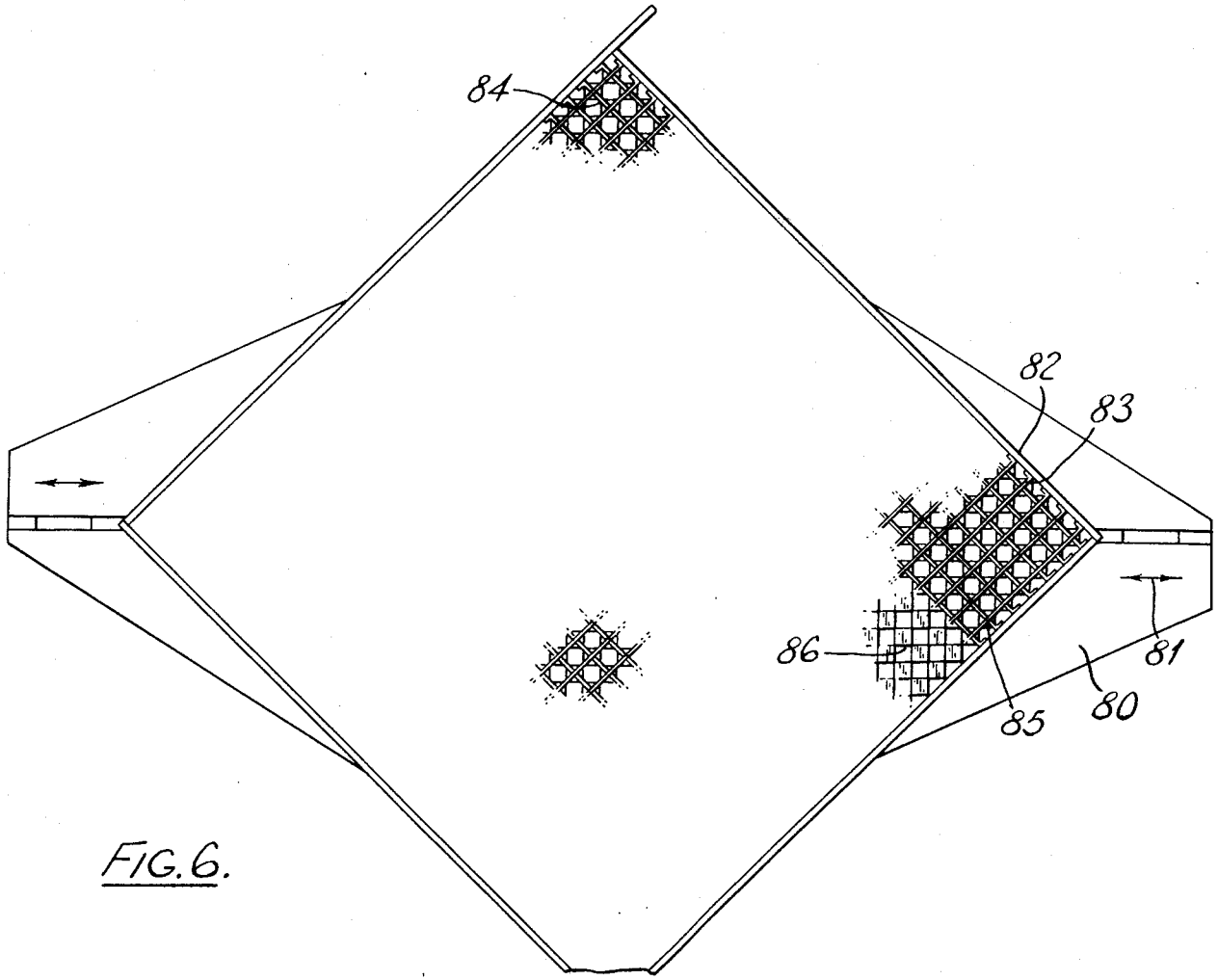
FIG. 6 is a fragmentary underneath plan view of the apparatus illustrating the slide valve arrangement.

FIG. 6 illustrates a slide valve which is positioned below the redistribution section 3 and it includes a plate member 80 movable back and forth as illustrated by the arrow 81 and this carries a square frame 82 having a series of parallel bars 83 thereon and at right angles thereto further parallel bars 84. These bars carry, at their junction, small square cross-section plates 85 arranged in a chequerboard array so that the "blacks" of the chequerboard are the plates and the "whites" of the chequerboard are the gaps therebetween. These can be aligned with the square or rectangular cross-section channels 86 of the third redistribution section 3.

Figure 7:
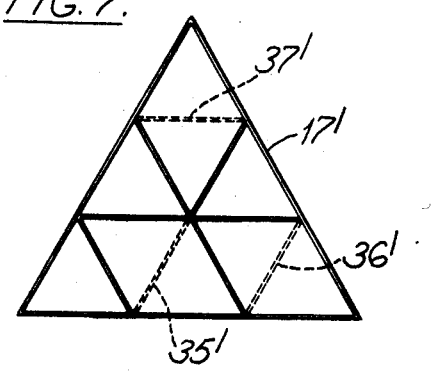
FIG. 7 is a view similar to FIG. 3 of a second embodiment.

FIG. 7 illustrates the second embodiment in which the cross-section of a hollow casing 17' is triangular and this is divided up by partitions to give a plurality of channels of triangular cross-section, three of these channels having redistributors 35', 36' and 37' therein.

In operation, one particulate material is fed into the tapered square cross-section duct 11 and another particulate material is fed into the hopper 10. When the slide valve 16 is opened, the two particulate materials fall under gravity into the first redistribution stage 1. Five ninths of the first particulate material then flow centrally unimpeded through the square cross-section ducts 31 to 34 to the secondary distribution stage. At the same time, four ninths of the first material is redistributed with an equal quantity of the second material by the redistribution helical elements 35 to 38. The remainder of the second material which was originally in the hopper 10 flows unimpeded to the triangular section channels formed between the walls of the casing 17 and of the various partitions. Thus, five ninths of the material is in substantially the same position as it was before the redistribution stage and four ninths of it has been moved into the position previously occupied by the material of the other kind.

In the subsequent stages a similar situation takes place, approximately half the material staying in the position it was in in the previous stage, the remainder being inverted. Thus, by defining the geometry of the channels, for example, to be square or triangular, the size of the channels in each row, the degree of redistribution and the channel position from row to row, mixing patterns can be achieved which are reproducable in a decreasing scale and the mixing is systematic and predictable. In the conventional method of mixing one attempts to move all of the particles from one lateral position to another, whereas according to the present invention only certain of the particles are moved, the remainder being left in the same lateral position as they were previously. The present invention is clearly more efficient and unlike conventional mixing of the particles the mixing is not dependent on the random movement of the particles relative to each other, but is dependent on clearly predictable movement of the particles.

In order to adjust the relative distribution in the final product one simply moves the slide valve 80 in the direction of the arrows 81 (in one direction or the other), to increase the proportion of one material and decrease the proportion of the other material.

It will be appreciated that while in the construction illustrated the form of slide valve has been illustrated only after the last stage, it could equally well be applied between any two of the stages or before the first stage.

We claim:

1. An apparatus for mixing particulate solid materials, by passing the materials through the apparatus, said apparatus comprising, in combination:

a. a hollow casing of polygonal cross-section;

b. at least one set of rectilinear partitions within the said casing extending parallel to the axis of the casing, the partitions of a set dividing the casing into a plurality of channels also of polygonal cross-section, arranged side by side in the casing; and c. redistributors located in some, but not all, of the channels defined by a set of partitions, effective to allow the flow of solid particulate material to be redistributed across the cross-section within each channel in which a redistributor is located, the shape of the channels without redistributors and the shape of the passages on each side of the redistributors at the upstream end of the channels with redistributors being substantially the same as that of the casing.

2. An apparatus as claimed in claim 1 wherein the hollow casing and the channels are of square cross-section.

3. An apparatus as claimed in claim 1, wherein the hollow casing and the channels are of triangular cross-section.

4. An apparatus as claimed in claim 1, wherein each redistributor comprises a generally helical element shaped so as to fill the polygonal section of the channel into which it is fitted.

5. An apparatus as claimed in claim 1, wherein the hollow casing has a plurality of sets of partitions dividing the casing into a plurality of stages, each stage having a plurality of channels of polygonal cross-section arranged side by side in the casing, the shape of the channels of each stage being substantially the same as that of the casing, each stage having more channels than the stage upstream thereof, only some, but not all, of the channels having one of said redistributors located therein.

6. An apparatus as claimed in claim 1, and further comprising at least one valving element movable transversely of each said channel, effective to block off a portion of the cross-section thereof.

7. An apparatus as claimed in claim 6, wherein said at least one valving member comprises a plurality of parallel spaced apart slats.

8. An apparatus as claimed in claim 7, wherein the spacing and width of the slats are equal to one another.

9. An apparatus as claimed in claim 6, wherein said channels are of square cross-section and wherein said at least one valving member comprises a series of square plates of the same size of the channels over which they move, and a grid of parallel rods disposed diagonally of the channels and plates, said plates being mounted on said rods in chequerboard fashion effective to define a plurality of square spaces therebetween.

10. An apparatus as claimed in claim 9, wherein the valving member is moved parallel to one of the sides of said square plates.

* * * * *